US008764919B2

(12) United States Patent
Nazmy et al.

(10) Patent No.: US 8,764,919 B2
(45) Date of Patent: Jul. 1, 2014

(54) HIGH-TEMPERATURE-RESISTANT COBALT-BASE SUPERALLOY

(75) Inventors: Mohamed Nazmy, Fislisbach (CH); Andreas Künzler, Baden (CH); Markus Staubli, Dottikon (CH)

(73) Assignee: Alstom Technology Ltd, Baden (CH)

( * ) Notice: Subject to any disclaimer, the term of this patent is extended or adjusted under 35 U.S.C. 154(b) by 75 days.

(21) Appl. No.: 12/554,624

(22) Filed: Sep. 4, 2009

(65) Prior Publication Data

US 2010/0061883 A1 Mar. 11, 2010

(30) Foreign Application Priority Data

Sep. 8, 2008 (CH) ..... 1433/08

(51) Int. Cl.
*C22C 19/07* (2006.01)

(52) U.S. Cl.
USPC ..... 148/425; 420/435

(58) Field of Classification Search
USPC ..... 420/435; 148/425
See application file for complete search history.

(56) References Cited

U.S. PATENT DOCUMENTS

| | | | | |
|---|---|---|---|---|
| 4,078,922 | A | 3/1978 | Magyar et al. | |
| 5,478,207 | A * | 12/1995 | Stec | 416/219 R |
| 2004/0025989 | A1 | 2/2004 | Chiba et al. | |
| 2008/0185078 | A1 | 8/2008 | Ishida et al. | |
| 2013/0206287 | A1 | 8/2013 | Sato et al. | |

FOREIGN PATENT DOCUMENTS

| | | | | |
|---|---|---|---|---|
| EP | 1 925 683 | A1 | 5/2008 | |
| EP | 1 935 997 | A1 * | 6/2008 | C22C 19/17 |
| GB | 1 516 795 | A | 7/1978 | |
| JP | 2-221346 | A | 9/1990 | |
| JP | 2-247367 | A | 10/1990 | |
| JP | 10-102175 | A | 4/1998 | |
| JP | 2002-97537 | A | 4/2002 | |
| JP | 2009-228024 | A | 10/2009 | |
| JP | 2011-246734 | A | 12/2011 | |
| JP | 2012-41627 | A | 3/2012 | |
| WO | 2007/032293 | A1 | 3/2007 | |

OTHER PUBLICATIONS

ASM International, Materials Park, Ohio, ASM Specialty Handbook:Nickel, Cobalt, and Their Alloys, "Metallography, Microstructures, and Phase Diagrams of Nickel and Nickel Alloys", Dec. 2000, pp. 302-304.*

Switzerland Search Report dated Nov. 5, 2008.

D.H. Ping, et al. "Microstructural Evolution of a Newly Developed γ' Strengthened Co-based Superalloy", National Institute for Materials Science, Sengen 1-2-1, Tsukuba 305-0047, Japan, 2006, pp. 513-514.

(Continued)

*Primary Examiner* — Jessee Roe

(74) *Attorney, Agent, or Firm* — Buchanan Ingersoll & Rooney PC

(57) ABSTRACT

A cobalt-base superalloy chemical composition is disclosed which includes, in % by weight: 25-28 W; 3-8 Al; 0.5-6 Ta; 0-3 Mo; 0.01-0.2 C; 0.01-0.1 Hf; 0.001 -0.05 B; 0.01-0.1 Si; and remainder Co and unavoidable impurities. This superalloy can be strengthened by γ' dispersions and further dispersion mechanisms. Exemplary compositions can provide good oxidation properties and improved strength values at high temperatures.

4 Claims, 5 Drawing Sheets

(56) References Cited

OTHER PUBLICATIONS

Akane Suzuki et al., "High-temperature strength and deformation of γ/γ' two-phase Co—Al—W-base alloys", ScienceDirect, 2008 pp. 1287-1297.

J. Sato et al., Cobalt-Base High-Temperature Alloys, science 312, 90 (2006), pp. 89-91.

English Translation of Office Action (Notification of Reasons for Refusal) issued on Sep. 24, 2013, by the Japanese Patent Office in corresponding Japanese Patent Application No. 2009-201623. (5 pages).

Second Office Action dated Jan. 11, 2013, issued in corresponding Chinese Patent Application No. 200910173389.9 (6 pages).

* cited by examiner

HIGH-TEMPERATURE-RESISTANT COBALT-BASE SUPERALLOY

RELATED APPLICATIONS

This application claims priority under 35 U.S.C. §119 to Swiss Patent Application No. 01433/08 filed in Switzerland on Sep. 8, 2008, the entire content of which is hereby incorporated by reference in its entirety.

FIELD

The disclosure relates to the field of materials science, and to a cobalt-base superalloy with a γ/γ' microstructure.

BACKGROUND INFORMATION

Cobalt-base and nickel-base superalloys are known.

For example, components made from nickel-base superalloys are known, in which a γ/γ' dispersion-hardening mechanism impacts the high-temperature mechanical properties. Such materials can have good strength, corrosion resistance and oxidation resistance along with good creep properties at high temperatures. When materials of this type are used in gas turbines, for example, these properties can allow for the intake temperature of the gas turbines to be increased and efficiency of the gas turbine installation can be increased.

By contrast, many cobalt-base superalloys can be strengthened by carbide dispersions and/or solid solution strengthening as a result of the alloying of high-melting elements, and this is reflected in reduced high-temperature strength as compared with the γ/γ' nickel-base superalloys. In addition, the ductility can be impaired by secondary carbide dispersions in the temperature range of approximately 650-927° C. Compared with nickel-base superalloys, however, cobalt-base superalloys can have improved hot corrosion resistance along with higher oxidation resistance and wear resistance.

Various cobalt-base cast alloys, such as MAR-M302, MAM509 and X-40, are commercially available for turbine applications, and these alloys have a comparatively high chromium content and are partly alloyed with nickel. A nominal composition of these alloys is shown in Table 1 in % by weight.

TABLE 1

Nominal composition of known commercially available cobalt-base superalloys

| | Ni | Cr | Co | W | Ta | Ti | Mn | Si | C | B | Zr |
|---|---|---|---|---|---|---|---|---|---|---|---|
| M302 | — | 21.5 | 58 | 10 | 9.0 | — | — | — | 0.85 | 0.005 | 0.2 |
| M509 | 10.0 | 23.5 | 55 | 7 | 3.5 | 0.2 | — | — | 0.60 | — | 0.5 |
| X-40 | 10.5 | 25.5 | 54 | 5.5 | — | — | 0.75 | 0.75 | 0.50 | — | — |

However, it would be desirable to improve mechanical properties, such as the creep strength of these cobalt-base superalloys.

Cobalt-base superalloys with a predominantly γ/γ' microstructure have also recently become known, and these have improved high-temperature strength as compared with the commercially available cobalt-base superalloys mentioned above.

A known cobalt-base superalloy of this type consists of (in at. % by weight):

27.6 Ni,
12.9 Ti,
8.7 Cr, 0.8 Mo,
2.6 Al,
0.2 W and
47.2 Co.

(D. H. Ping et al: Microstructural Evolution of a Newly Developed Strengthened Co-base Superalloy, Vacuum Nanoelectronics Conference, 2006 and the 50th International Field Emission Symposium., IVNC/IFES 2006, Technical Digest. 19$^{th}$ International Volume, Issue, July 2006, Pages 513-514).

Relatively high chromium and nickel contents, and additionally also titanium, are present in this alloy. The microstructure of this alloy includes a known γ/γ' structure having a hexagonal $(Co,Ni)_3Ti$ compound with plate-like morphology, in which case the latter can have an adverse effect on high-temperature properties. The use of alloys of this type is limited to temperatures below 800° C.

In addition, Co-AM-base γ/γ' superalloys have also been disclosed (Akane Suzuki, Garret C. De Nolf, and Tresa M. Pollock: High Temperature Strength of Co-based γ/γ'-Superalloys, Mater. Res. Soc. Symp. Proc. Vol. 980, 2007, Materials Research Society). The alloys investigated in this document each comprise 9 at. % Al and 9-11 at. % W, with 2 at. % Ta or 2 at. % Re optionally being added. This document discloses that the addition of Ta to a ternary Co—Al—W alloy can stabilize the γ' phase, and the ternary system (i.e. without Ta) can have approximately cuboidal γ' dispersions with an edge length of approximately 150 and 200 nm, whereas the microstructure of the alloy additionally containing 2 at. % Ta can have cuboidal γ' dispersions with an edge length of approximately 400 nm.

SUMMARY

A cobalt-base superalloy chemical composition comprising in % by weight: 25-28 W; 3-8 Al; 0.5-6 Ta; 0-3 Mo; 0.01-0.2 C; 0.01-0.1 Hf; 0.001-0.05 B; 0.01-0.1 Si; and remainder Co and unavoidable impurities.

A gas turbine component containing a cobalt-base superalloy chemical composition comprising in % by weight: 25-28 W; 3-8 Al; 0.5-6 Ta; 0-3 Mo; 0.01-0.2 C; 0.01-0.1 Hf; 0.001-0.05 B; 0.01-0.1 Si; and remainder Co and unavoidable impurities.

BRIEF DESCRIPTION OF THE DRAWINGS

Exemplary embodiments of the disclosure are illustrated in the drawings, in which.

DETAILED DESCRIPTION

Figure 1:
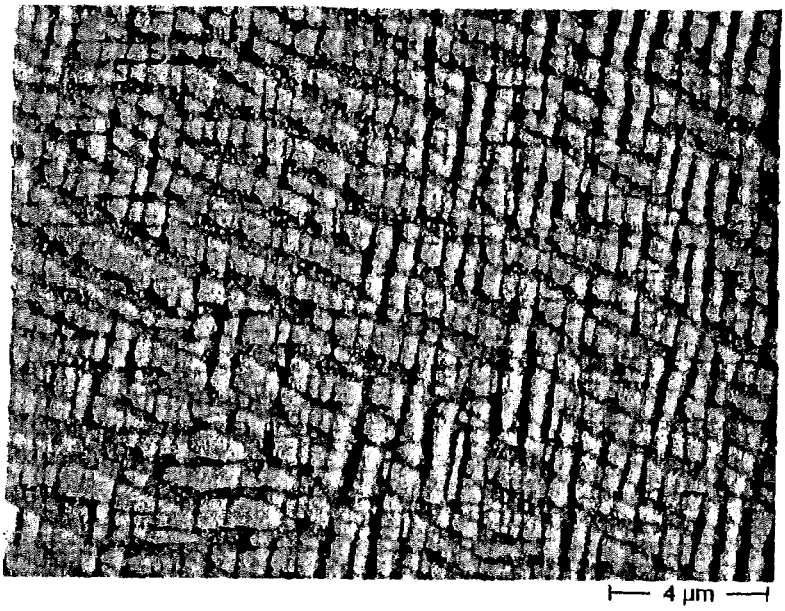
FIG. 1 shows an image of an exemplary microstructure of the alloy Co-1 according to the disclosure.

A cobalt-base superalloy is disclosed which, for example, at high operating temperatures of up to approximately 1000° C. (or higher), can have improved mechanical properties and good oxidation resistance. The alloy can also be suitable for producing single-crystal components.

According to the disclosure, a cobalt-base superalloy can have the following chemical composition (in % by weight):

25-28 W,
3-8 Al,
0.5-6 Ta,
0-3 Mo,
0.01-0.2 C,
0.01-0.1 Hf,
0.001-0.05 B,
0.01-0.1 Si, remainder Co and unavoidable impurities.

The alloy includes (e.g, consists of) a face-centered cubic γ-Co matrix phase and a high volumetric content of γ' phase $Co_3(Al,W)$ stabilized by Ta. In accordance with exemplary embodiments, γ' dispersions are very stable and strengthen the material, and this can have a positive effect on properties (e.g., creep properties, oxidation behavior) at, for example, high temperatures.

The exemplary Co superalloy contains neither Cr nor Ni, but consequently can have a relatively high W content. This high tungsten content (e.g., 25-28% by weight, or higher if desired) can further strengthen the γ' phase and improve creep properties. W arrests lattice dislocation between the γ matrix and the γ' phase, in which case a low lattice dislocation can enable a coherent microstructure to be formed.

Ta additionally can act as a dispersion strengthener. For example, 0.5 to 6% by weight Ta, preferably 5.0-5.4% by weight Ta, can be added. Ta can increase the high-temperature strength. If more than 6% by weight of Ta is present, oxidation resistance can be reduced.

The alloy contains, by way of example, 3-8% by weight Al, preferably 3.1-3.4% by weight Al. This can form a protective $Al_2O_3$ film on the material surface, which can increase oxidation resistance at high temperatures.

B is an element which can be included, by way of example, in small amounts of 0.001 up to max. 0.05% by weight, to strengthen grain boundaries of the cobalt-base superalloy. Higher contents of boron can be important, and in some cases critical, as they can lead to undesirable boron dispersions which can have an embrittling effect. In addition, B can reduce the melting temperature of the Co alloy, and contents of boron of more than 0.05% by weight may therefore not be desirable. The interplay of boron in the range specified with the other constituents, such as with Ta, can result in good strength values.

Mo can be a solid solution strengthener in the cobalt matrix. Mo can, for example, influence lattice dislocation between the γ matrix and the γ' phase and the morphology of γ' under creep loading.

In a specified exemplary range of 0.01 up to max. 0.2% by weight, C can be useful for formation of carbide, which, in turn, can increase strength of the alloy. C additionally can act as a grain boundary strengthener. By contrast, if more than 0.2% by weight of carbon is present in exemplary embodiments, this can result in embrittlement.

Hf (in an exemplary specified range of 0.01-0.1% by weight) can strengthen the γ matrix and contribute to an increase in strength. In addition, Hf in combination with 0.01-0.1% by weight Si can improve oxidation resistance. In exemplary embodiments disclosed herein, if the ranges specified are exceeded, the material can be embrittled.

If C, B, Hf and Si are present in amounts at exemplary lower limits of the ranges specified, single-crystal alloys can be produced, and properties of the Co alloys can be improved, for example, with regard to their use in gas turbines (high degree of loading in terms of temperature, oxidation and corrosion).

Seen as a whole, cobalt-base superalloys according to the disclosure, have chemical compositions (combination of the elements indicated in the ranges specified), which can provide outstanding properties at high temperatures of up to approximately 1000° C. (or greater), such as good creep rupture strength (i.e. good creep properties), and extremely high oxidation resistance.

An investigation was carried out into high-temperature mechanical properties of known, commercially available cobalt-base superalloys Mar-M302, Mar-M509 and X-40 (see Table 1 for the compositions), the Co—Al—W—Ta-γ/γ' superalloy including (e.g., consisting of) 9 at. % Al, 10 at. % W and 2 at. % Ta, remainder Co, as known from literature, and exemplary alloys according to the disclosure as listed in Table 2.

In Table 2, alloying constituents of exemplary alloys Co-1 to Co-5 according to the disclosure are specified in % by weight:

TABLE 2

Compositions of exemplary investigated alloys according to the disclosure

| | Co | W | Al | Ta | C | Hf | Si | B | Mo |
|---|---|---|---|---|---|---|---|---|---|
| Co-1 | Rem. | 26 | 3.4 | 5.1 | 0.2 | 0.1 | 0.1 | 0.05 | — |
| Co-2 | Rem. | 27.25 | 8 | 5.2 | 0.2 | 0.1 | 0.1 | 0.05 | — |
| Co-3 | Rem. | 26 | 3.4 | 0.5 | 0.2 | 0.1 | 0.05 | 0.05 | 2.8 |
| Co-4 | Rem. | 25.5 | 3.1 | 5 | 0.2 | 0.1 | 0.05 | 0.05 | — |
| Co-5 | Rem. | 25.5 | 3.1 | 5.2 | 0.2 | 0.1 | 0.05 | 0.05 | — |

Comparative alloys Mar-M302, Mar-M509 and X-40 were investigated as cast.

The exemplary alloys according to the disclosure were subjected to the following exemplary heat treatment:

solution annealing at 1200° C./15 h under inert gas/air cooling; and annealing at 1000° C./72 h under inert gas/air cooling (dispersion treatment).

FIG. 1 depicts an exemplary microstructure achieved in this way for an alloy Co-1 according to the disclosure. FIG. 1 shows a fine distribution of a dispersed γ' phase in a γ matrix. These γ' dispersions are very similar to the γ' phase of known nickel-base superalloys. It can be expected that the γ' dispersions in this cobalt-base superalloy are more stable than those in the nickel-base superalloys. This is due, for example, to the presence of tungsten in a form of $Co_3(Al,W)$ which has a low diffusion coefficient.

Figure 2:
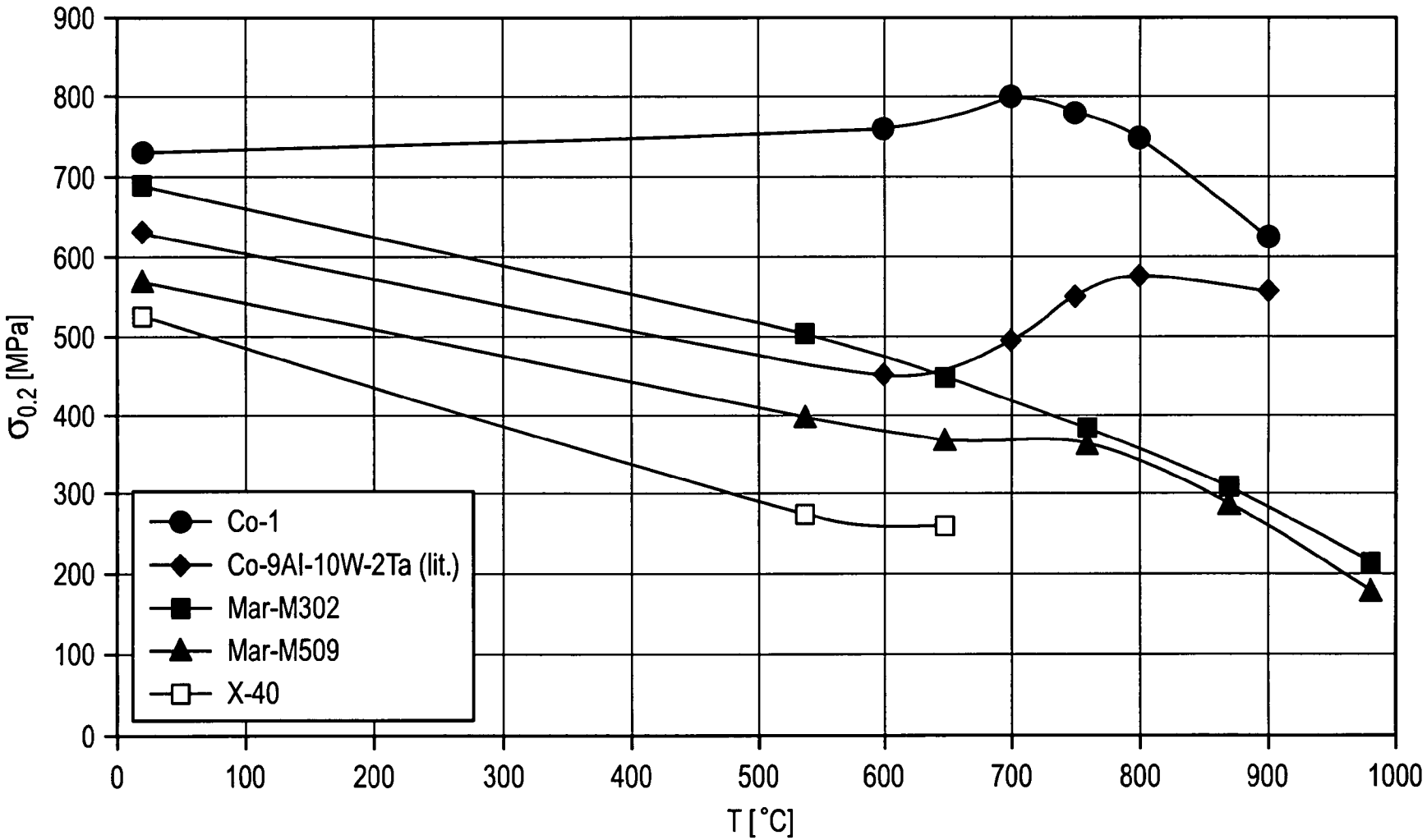
FIG. 2 shows a yield strength $\sigma_{0.2}$ of the alloy Co-1 and of known comparative alloys as a function of temperature in a range from room temperature up to approximately 1000° C.

FIG. 2 shows a variation in yield strength $\sigma_{0.2}$ for the exemplary alloy Co-1 according to the disclosure as a function of temperature in a range from room temperature up to approximately 1000° C. FIG. 2 also illustrates the results for commercially available comparative alloys listed in Table 1 and for the Co—Al—W—Ta alloy known from the literature.

Throughout the temperature range investigated, the yield strength $\sigma_{0.2}$ of the alloy Co-1 is higher than the yield strength $\sigma_{0.2}$ of the three commercially available comparative alloys, the difference being particularly pronounced at temperatures >600° C. In a range of approximately 700-900° C., the yield strength of the cobalt-base superalloy Co-1 is approximately twice that of the best known commercially available alloy M302 investigated here. Although the yield strength $\sigma_{0.2}$ of the Co—Al—W—Ta alloy known from the literature is superior to that of the commercially available comparative alloys in the relatively high temperature range above approximately 650° C., considerably better values can be achieved with the exemplary alloy according to this disclosure. This is, for example, because the elements C, B, Hf, Si and, if appropriate, Mo additionally present in exemplary alloys according to the disclosure can provide additional strengthening mechanisms (dispersion strengthening, grain boundary strengthening, solid solution strengthening) in addition to advantages already described of the γ/γ' microstructure of cobalt-base superalloys.

Figure 3:
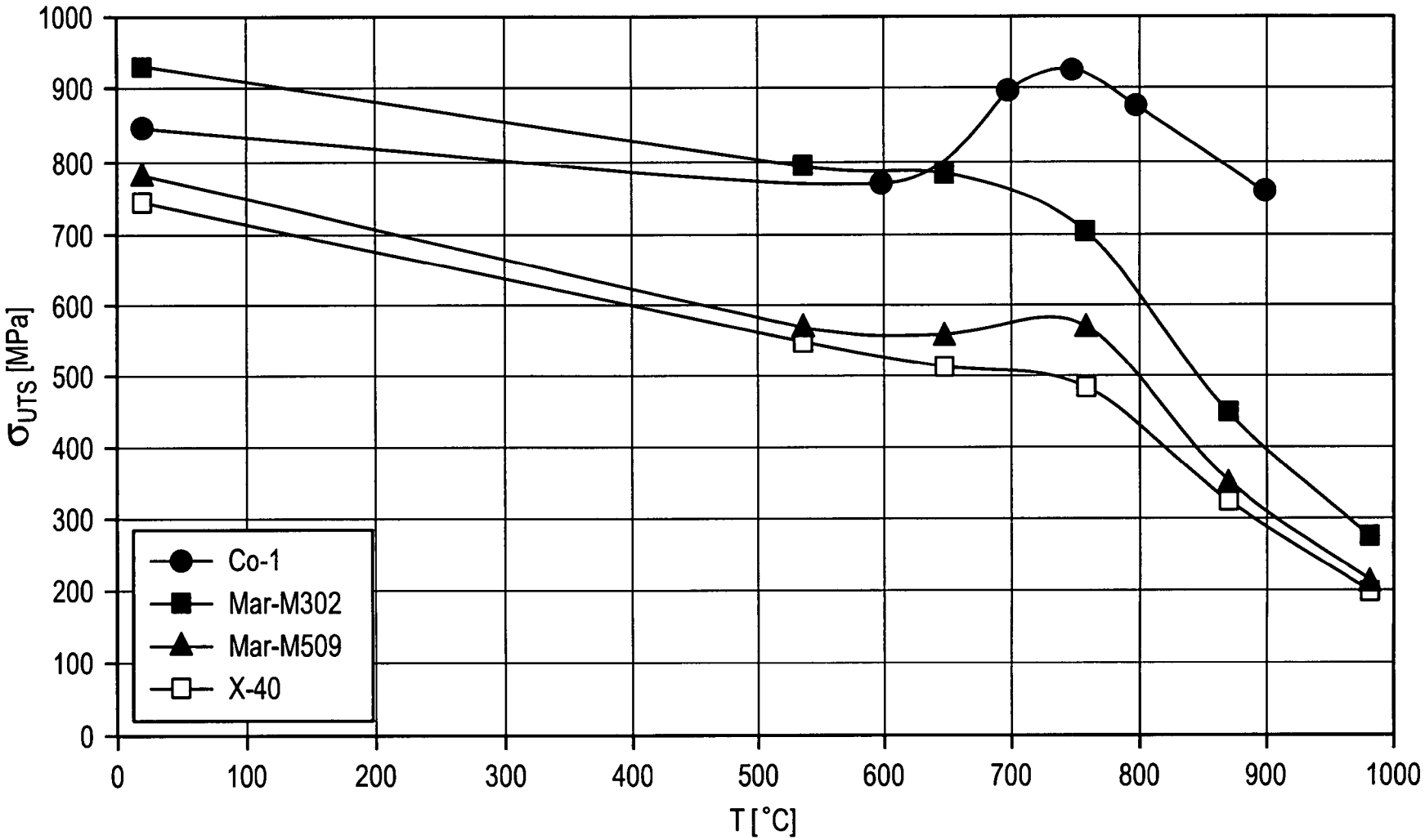
FIG. 3 shows ultimate tensile strength $\sigma_{UTS}$ of the alloy Co-1 and of known comparative alloys as a function of temperature in a range from room temperature up to approximately 1000° C.

FIG. 3 illustrates an ultimate tensile strength $\sigma_{UTS}$ of the exemplary alloy Co-1 and of known comparative alloys described in Table 1 as a function of temperature in a range from room temperature up to approximately 1000° C. In a temperature range from room temperature up to approximately 600° C., the known superalloy M302 has highest ultimate tensile strength values; at temperatures above approximately 600° C., the exemplary cobalt-base superalloy Co-1 according to the disclosure has even higher ultimate tensile strength values. At 900° C., the ultimate tensile strength of Co-1 is approximately twice that of M302 and even approximately 2.5 times higher than that of M509 and X-40. This is, for example, due to the finely distributed γ' phase, which strengthens the microstructure, and due to additional strengthening provided by the alloying elements C, B, Hf, Si. However, this is at the expense of elongation at break, as can be gathered from FIG. 4.

Figure 4:
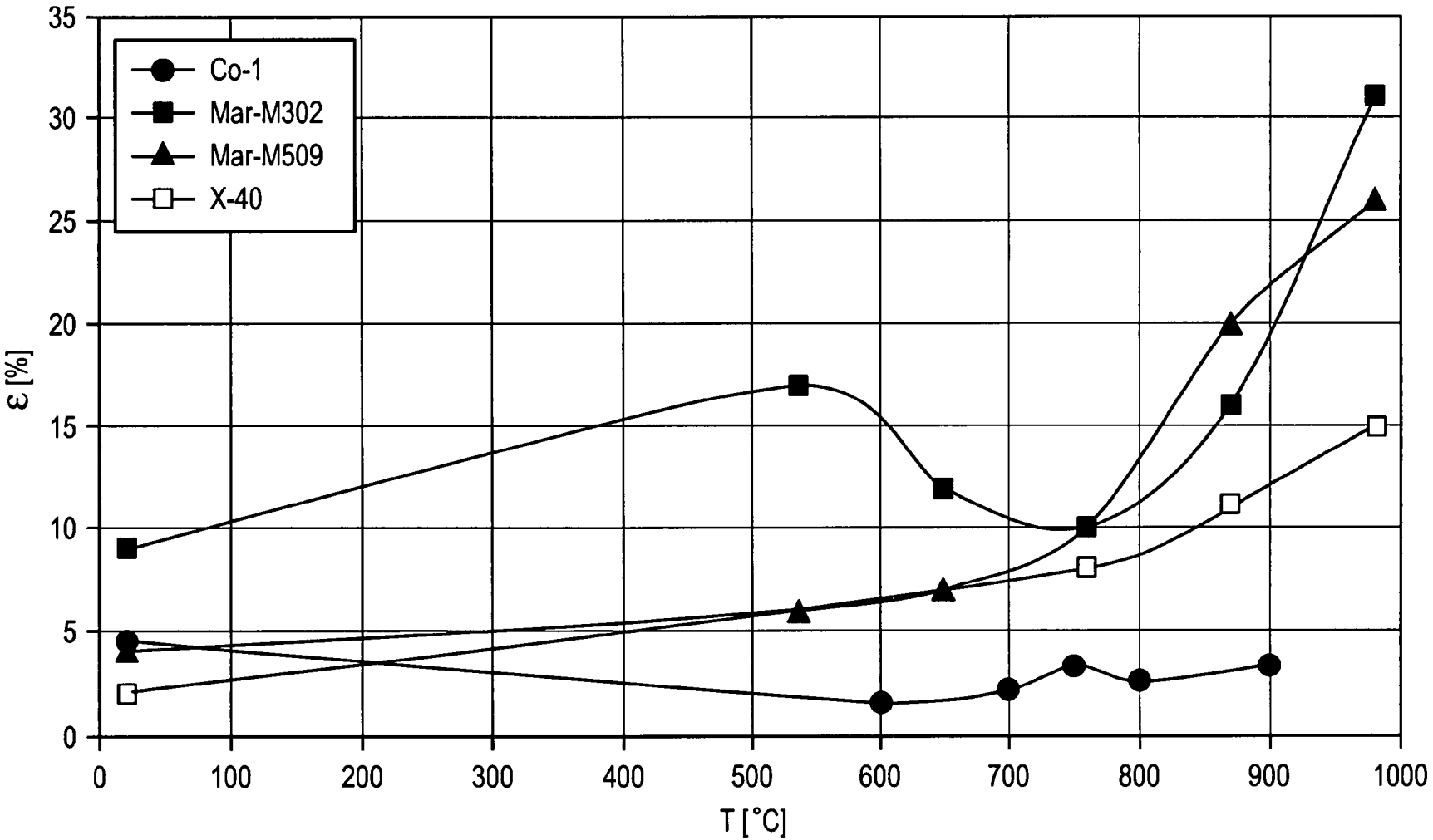
FIG. 4 shows an elongation at break $\epsilon$ of the alloy Co-1 and of known comparative alloys as a function of temperature in a range from room temperature up to approximately 1000° C.

FIG. 4 illustrates elongation at break $\epsilon$ of the exemplary alloy Co-1 and of known comparative alloys as a function of temperature in a range from room temperature up to approximately 1000° C. Whereas the elongation at break of the alloy Co-1 is still above values for the commercially available alloys M509 and X-40 at room temperature, it is very much lower at higher temperatures. The alloy M302 has the best elongation at break virtually throughout the temperature range investigated.

Figure 5:
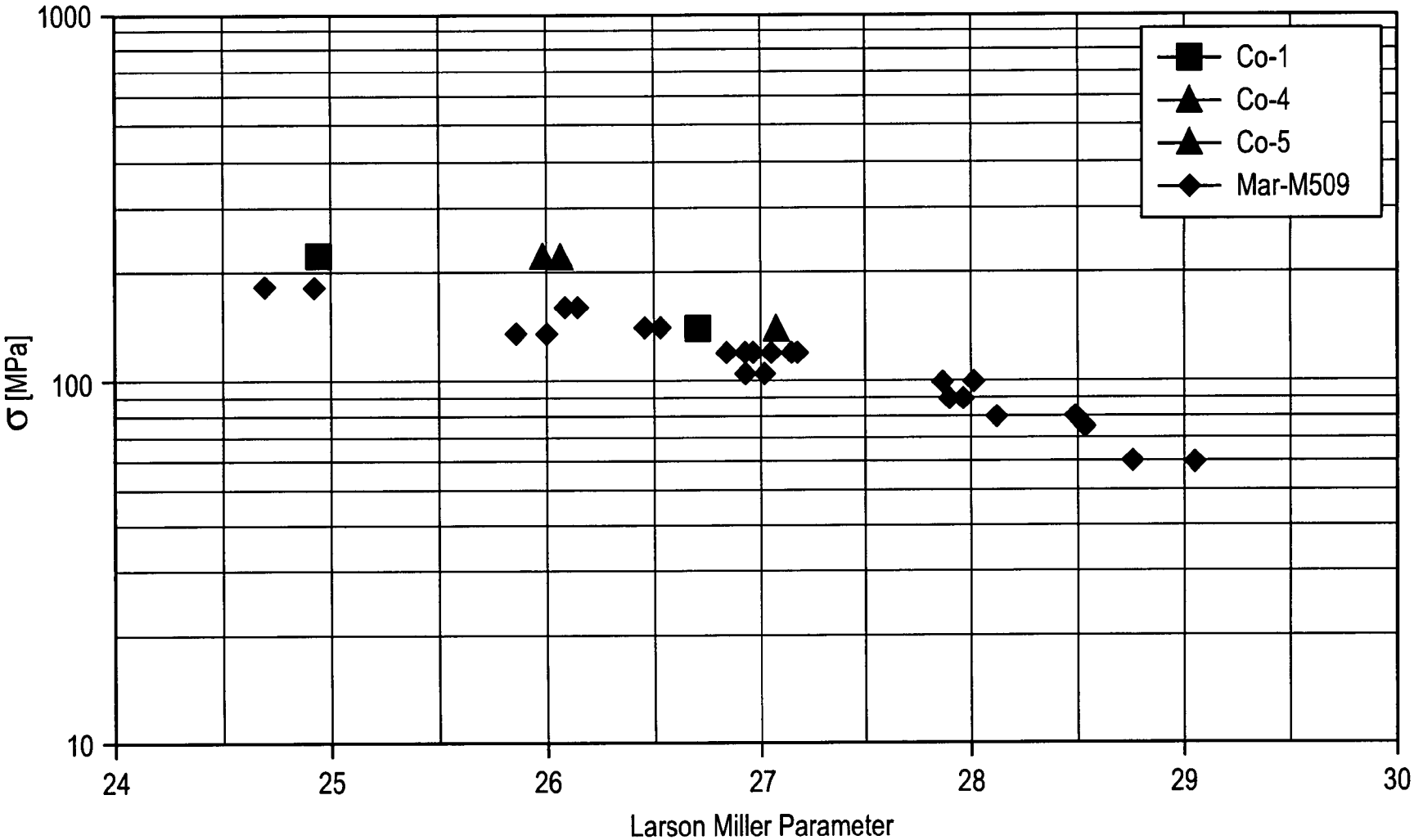
FIG. 5 shows a stress $\sigma$ of exemplary alloys Co-1, Co-4 and Co-5 according to the disclosure and of the known comparative alloy Mar-M509 as a function of the Larson Miller Parameter.

FIG. 5 shows stress σ of the exemplary alloys Co-1, Co-4 and Co-5 according to the disclosure and of a known comparative alloy Mar-M509 as a function of the Larson Miller Parameter PLM, which describes an influence of age-hardening time and temperature on creep behavior. The Larson Miller Parameter PLM is calculated as follows:

$$PLM=T(20+\log t)10^{-3}$$

where T: temperature in ° K.

t: time in hours.

In FIG. 5, rupture times have been used in each case as age-hardening times. Given a comparable Larson Miller Parameter, alloys Co-1, Co-4 and Co-5 according to the disclosure all withstand greater stresses than the comparative alloy (i.e., they have improved creep properties), and this can be attributed to, for example, dispersion of the γ' phase and associated strengthening, as well as additional strengthening mechanisms mentioned above.

High-temperature components for gas turbines, such as blades or vanes (e.g., guide blades or vanes, or heat shields), can advantageously be produced from the cobalt-base superalloys according to the disclosure. As a result of the good creep properties of the material, these components can be used, for example, at very high temperatures.

The disclosure is not restricted to the exemplary embodiments described above. For example, it is also possible to produce single-crystal components from cobalt-base superalloys, specifically when for example the contents of C and B (B and C are grain boundary strengtheners), and the contents of Hf and Si are reduced in comparison with the examples described above, while at the same time choosing proportions by weight which lie more at a lower limit of the ranges for these elements specified in the exemplary embodiments described herein.

An example of a Co-base single-crystal superalloy of this type is an alloy having the following chemical composition (in % by weight):

26 W, 3.4 Al, 5.1 Ta, 0.02 C, 0.02 Hf, 0.002 B, 0.01 Si, remainder Co and unavoidable impurities.

In the case of Co—W—Al—Ta-base single-crystal superalloys as described in accordance with exemplary embodiments herein, the following exemplary ranges (in % by weight) can be chosen for additional doping elements:

0.01-0.03, preferably 0.02 C,
0.01-0.02, preferably 0.02 Hf,
0.001-0.003, preferably 0.002 B,
0.01-0.02, preferably 0.01 Si.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A cobalt-base superalloy chemical composition consisting of:

25-28% by weight W;
3-8% by weight Al;
0.5-6% by weight Ta;
0-3% by weight Mo;
0.01-0.2% by weight C;
0.01-0.1% by weight Hf;
0.001-0.05% by weight B;
0.01-0.1% by weight Si; and
remainder Co and unavoidable impurities; and
wherein the superalloy has a microstructure including a γ-phase matrix and a γ'-phase dispersed in the matrix,
wherein the γ-phase matrix comprises a face centered cubic γ-Co phase, and
wherein the γ'-phase comprises $Co_3(Al,W)$ stabilized by Ta.

2. A gas turbine component containing a cobalt-base superalloy chemical composition consisting of:

25-28% by weight W;
3-8% by weight Al;
0.5-6% by weight Ta;
0-3% by weight Mo;
0.01-0.2% by weight C;
0.01-0.1% by weight Hf;
0.001-0.05% by weight B;
0.01-0.1% by weight Si; and
remainder Co and unavoidable impurities; and wherein the superalloy has a microstructure including a γ-phase matrix and a Γ'-phase dispersed in the matrix, wherein the γ-phase matrix comprises a face centered cubic γ-Co phase, and wherein the γ'-phase comprises $Co_3(Al,W)$ stabilized by Ta.

3. A cobalt-base superalloy formed as a single-crystal, the superalloy chemical composition consisting of:

26% by weight W;

3.4% by weight Al;

5.1% by weight Ta;

0.02% by weight C;

0.02% by weight Hf;

0.002% by weight B;

0.01% by weight Si; and remainder Co and unavoidable impurities.

4. A cobalt-base superalloy, wherein the chemical composition consists of:

26% by weight W;

3.4% by weight Al;

5.1% by weight Ta;

0.2% by weight C;

0.1% by weight Hf;

0.05% by weight B;

0.1% by weight Si; and remainder Co and unavoidable impurities; and wherein the superalloy has a microstructure including a γ-phase matrix and a γ'-phase dispersed in the matrix, wherein the γ-phase matrix comprises a face centered cubic γ-Co phase, and wherein the γ'-phase comprises $Co_3(Al,W)$ stabilized by Ta.

* * * * *